US006619681B2

(12) United States Patent
Gutierrez

(10) Patent No.: US 6,619,681 B2
(45) Date of Patent: Sep. 16, 2003

(54) DYNAMIC SEATING AND WALKING WHEELCHAIR

(75) Inventor: Charlie Gutierrez, Delano, CA (US)

(73) Assignee: Delano Association for the Developmentally Disabled, Delano, CA (US)

( * ) Notice: Subject to any disclaimer, the term of this patent is extended or adjusted under 35 U.S.C. 154(b) by 73 days.

(21) Appl. No.: 09/859,830

(22) Filed: May 16, 2001

(65) Prior Publication Data

US 2003/0146601 A1 Aug. 7, 2003

(51) Int. Cl.[7] ..... A61G 5/14
(52) U.S. Cl. ..... 280/250.1; 280/650; 297/DIG. 10
(58) Field of Search ..... 280/242.1, 250.1, 280/304.1, 647, 650; 297/DIG. 4, DIG. 10, 338

(56) References Cited

U.S. PATENT DOCUMENTS

| | | | | |
|---|---|---|---|---|
| 2,572,149 A | | 10/1951 | Hind et al. | |
| 2,596,055 A | | 5/1952 | Thomas | |
| 2,854,063 A | * | 9/1958 | Stallard | 297/338 |
| 3,023,048 A | | 2/1962 | Barton | |
| 3,261,031 A | | 7/1966 | Gates | |
| 3,398,974 A | | 8/1968 | Edwards et al. | |
| 3,787,089 A | | 1/1974 | Wrethander | |
| 3,999,778 A | | 12/1976 | Markiel | |
| 4,054,319 A | | 10/1977 | Fogg, Jr. et al. | |
| 4,067,249 A | | 1/1978 | Deucher | |
| 4,076,304 A | | 2/1978 | Deucher | |
| 4,119,164 A | | 10/1978 | Fogg, Jr. et al. | |
| 4,249,774 A | | 2/1981 | Andreasson | |
| 4,390,076 A | | 6/1983 | Wier et al. | |
| 4,506,930 A | | 3/1985 | Lambert | |
| 4,510,633 A | * | 4/1985 | Thorne | 280/250.1 |
| 4,598,944 A | | 7/1986 | Meyer | |
| 4,704,749 A | * | 11/1987 | Aubert | 280/250.1 |
| 4,744,578 A | | 5/1988 | Stearns | |
| 4,809,804 A | | 3/1989 | Houston et al. | |
| 4,862,997 A | * | 9/1989 | Eberle | 297/DIG. 4 |
| 4,948,156 A | | 8/1990 | Fortner | |
| 5,096,008 A | | 3/1992 | Mankowski | |
| 5,346,280 A | | 9/1994 | Deumite | |
| 5,366,036 A | | 11/1994 | Perry | |
| 5,676,388 A | * | 10/1997 | Bertani | 280/250.1 |
| 5,772,226 A | | 6/1998 | Bobichon | |
| 6,070,898 A | * | 6/2000 | Dickie et al. | 280/304.1 |
| 6,125,957 A | * | 10/2000 | Kauffmann | 297/DIG. 10 |

FOREIGN PATENT DOCUMENTS

| | | | | |
|---|---|---|---|---|
| GB | 2135183 | * | 8/1984 | 280/250.1 |

OTHER PUBLICATIONS

Flaghouse Catalog, Fall 2000/Winter 2001 pp. 163, 165, 166, 167.
Sammons Preston Catalog, 2000 p. 459.

* cited by examiner

*Primary Examiner*—Frank Vanaman
(74) *Attorney, Agent, or Firm*—James M. Duncan

(57) ABSTRACT

A device which functions as a conventional wheelchair, a dynamic seating device, a stander and a hands-free walker. The device raises the user to a standing position from a seated position, allowing the user to propel the device by the user's legs and feet. The seat carriage is slideably attached to vertical support members such that the seat carriage may be slid and positioned from a lower position to an upper position and from the upper position to the lower position. As the seat carriage is raised, the seat swings from generally horizontal first position to a generally vertical second position. As the seat carriage is lowered, the seat swings from the second position to the first position.

15 Claims, 7 Drawing Sheets

DYNAMIC SEATING AND WALKING WHEELCHAIR

BACKGROUND OF THE INVENTION

The present invention relates to wheelchairs, and more particularly to a wheelchair which, in addition to functioning as a standard wheelchair, further assists the user to come to a standing position, and stabilizes the user while standing and walking. In addition to its other benefits, this invention provides a mechanism by which a handicapped person may routinely undertake therapy and rehabilitative gait training without the necessity of other specialized equipment and with a minimal amount of assistance. This invention allows the user to enjoy a large range of seating and standing positions, including, among other movement, the user to place their feet on the floor and extend his or her legs at various angles up to and including the locked standing position. The user is thus able to make postural adjustments which provide relief from the discomfort and pain which otherwise results when one is unable to make unconscious body movements or postural adjustments.

The physical and psychological benefits of wheelchairs which bring the user to a standing position have long been recognized. A person who remains seated all of the time may suffer a broad range of complications and discomforts, including skin breakdown, problems with postural stability, difficulties with breathing and swallowing, incontinence, impaired sensation, and pressure ulcers. A variety of different devices have been proposed for relieving these problems by raising a wheelchair user from a seated position to a standing position, or assisting a wheelchair user to maintain a standing position or ambulate with his or her legs. In this regard, two general types of devices are known. The first types of device are wheelchairs which raises the user to a standing position. The second types of device are walkers which attach to a wheelchair or used in conjunction with a wheelchair. The first type of device raises the wheelchair user to a standing position, but retains the user's feet secured to the footrests or other parts of the wheelchair. Examples of this type of device are found in the following U.S. Pat. Nos.: 4,054,319; 4,067,249; 4,598,944; 5,096,008; 5,366,036; and 5,772,226. While in the standing position in this type of device, the device is generally not propelled by the user's feet, but instead by other means such as a second person, by the user's arms, or by a self-contained motor. While many of these devices combine the features of a general purpose wheelchair with a "stand-up" mechanism, the geometry of these devices places the users' body in a position which is not naturally balanced or appropriate for use as a walker.

The second type of device functions as a walker, allowing a wheelchair user not only to stand, but also to ambulate using his or her own feet to propel the device. Examples of this type of device are found in the following U.S. Pat. Nos.: 2,596,055; 3,023,048; 3,398,974; 3,999,778; and 4,948,156. There are known physical benefits in assisting a person to a standing position where the person's own skeletal structure provides the support. Such benefits include improved bowel and bladder regularity, strengthening of the cardiovascular system, reduction of edema in lower extremities, assisting the lungs in staying clear, improved digestive metabolic process, lessening of muscle spasms and contractions, stretching of tendons and ligaments in lower extremities, and reducing calcium loss in bones.

The inventions proposed for a walker type of device generally disclose an attachment to be used in conjunction with a standard wheelchair. For example, U.S. Pat. No. 3,3998,974 describes a walker attachment which enables the patient to stand up and walk in front of the wheel chair. However, few of the walker devices include a self-contained mechanism for assisting the user in coming to a standing position. One of the few devices which does include such a mechanism is found in U.S. Pat. No. 4,948,156, in which the disclosed transportable frame which can be attached to a wheelchair includes a hand-operated winch mechanism. The user operates the winch to activate a seat harness which pulls the user into a standing position. Another disadvantage of this type of device is that the known walker attachments are generally bulky, not easily stored, increase the total weight of the wheel chair, and constitute yet even further equipment with which a handicapped person is surrounded by and isolated within.

A need exists for a wheelchair which functions both as a wheelchair and as a stander and walker, which is space-efficient, and which brings the user to a standing position with little effort. A need further exists for a wheelchair which enables its user to make postural adjustments, i.e., dynamic seating, to allow the user relief from the discomfort and chronic pain associated with sitting in a single static position.

SUMMARY OF THE INVENTION

The present invention is directed to a dynamic seating and walking wheelchair which meets the needs identified above. The disclosed apparatus functions as a conventional wheelchair, but also enables the user to easily achieve a wide range of position from sitting to standing, thereby allowing the user to enjoy postural adjustments as desired. The device also functions as a stander, walker and hands-free walker. Because the invention is generally the same size as a conventional wheelchair, and does not utilize bulky attachments to function as a walker, this device is space efficient. In addition, the present invention is less confining and isolating than the known walkers, the present invention having minimal structural members in front of the user. When functioning as a walker, the present invention provides a stable support platform for the user, allowing the user to propel the walker through the use of the user's legs and feet, without structural members of the device limiting the user's range of leg motion. The present invention, when used with appropriate support means such as a harness, will also allow the user to stand and be supported without the use of his or her arms or hands and without any assistance from other persons.

In addition to its other benefits, the present invention may be used for therapeutic purposes, including gait training. The benefits of ambulation are well known, and include increased balance and endurance, and improved range of motion and circulation. The user may use the walking function of the present invention at the user's personal convenience, greatly increasing the convenience and frequency of therapy. Therapy which otherwise requires the use of special equipment, such as hand rails, and the assistance of others to assist the handicapped person in using therapy equipment, may be conducted at the user's convenience, resulting in lower expenses for therapy.

One embodiment of the disclosed apparatus comprises a generally horizontal base frame, a plurality of ground-engaging wheels connected to the base frame and a plurality of vertical tracks connected to the base frame in which the vertical tracks extend generally upward from the base frame. A seat carriage, having a vertical frame, an upright seat back and a seat, is slideably attached to the vertical tracks such that the seat carriage may be slid from and positioned at and between a lower position to an upper position and from the upper position to the lower position. The seat carriage may also be stopped at any position between the upper position and the lower position, as desired by the user. The upright seat back is attached to the vertical frame. The seat is pivotally mounted to the vertical frame such that the seat is swingable from a generally horizontal first position extending perpendicularly from the vertical frame to a generally vertical second position parallel to the vertical frame, and back again. The embodiment includes means for raising the seat carriage to the upper position and for lowering the seat carriage to the lower position.

The disclosed apparatus may also be fabricated such that as the seat carriage is raised, the seat simultaneously swings from the generally horizontal first position to the generally vertical second position, and, as the seat carriage is lowered, the seat frame simultaneously swings from the second position to the first position. The seat carriage may be slideably connected to the vertical support members with vertical bearings. The vertical bearings may be connected to the seat carriage with flexible connectors. Various means may be used for raising and lowering the seat carriage. One such means comprises a cable having a first and second end, the first end attached to the seat carriage and the second end attached to a winch adapted to wind and unwind the cable. A second means comprises a cable having a first and second end, the first end attached to the seat carriage and the second end attached to a sheave, the sheave attached to a gearbox and the gearbox coupled to a motor. Another means for raising and lowering the seat carriage comprises a motor coupled to a linear actuator, wherein the linear actuator is connected to the vertical frame. If one of the motor means is used, a motor control switch may be added to allow the user to control the raising and lowering function from the device.

While adaptable to different wheel combinations, the present invention may also comprise a ground-engaging main wheels, and a plurality of ground-engaging support wheels, including front wheels and rear wheels. A seat frame, comprising a left member, a right member and a front member may be substituted for the seat, wherein a left leg support is attached to the left member and the front member of the seat frame and a right leg support is attached to the right member and the front member of the seat frame. When the seat frame is used, a saddle may be added such that when the seat frame is in the first position, the left leg support, the right leg support, and the saddle provide a seating surface for the user, the saddle positioned between the left leg support and the right leg support. The saddle extends forwardly and generally horizontally from the vertical frame. There are different options for attaching the saddle to the vertical frame, including fixed attachment, attaching the saddle with a quick disconnect, or pivotally attaching the saddle so that it swings out of the user's way.

These and other features, aspects, and advantages of the present invention will become better understood with regard to the following description, appended claims, and accompanying drawings.

BRIEF DESCRIPTION OF THE DRAWINGS

FIG. 19 shows a rear view of an alternative embodiment with the seat carriage in the upper position.

DETAILED DESCRIPTION OF THE EMBODIMENTS

This detailed description shall make use of the following conventions in describing the embodiments of the disclosed device: the terms "front," "rear," "left" and "right" are with respect to the orientation of the user while operating the device. The terms "up," "upper," "upwardly," "lower," "down," and "downwardly" are with respect to the surface upon which the disclosed device is traveling.

Figure 1:
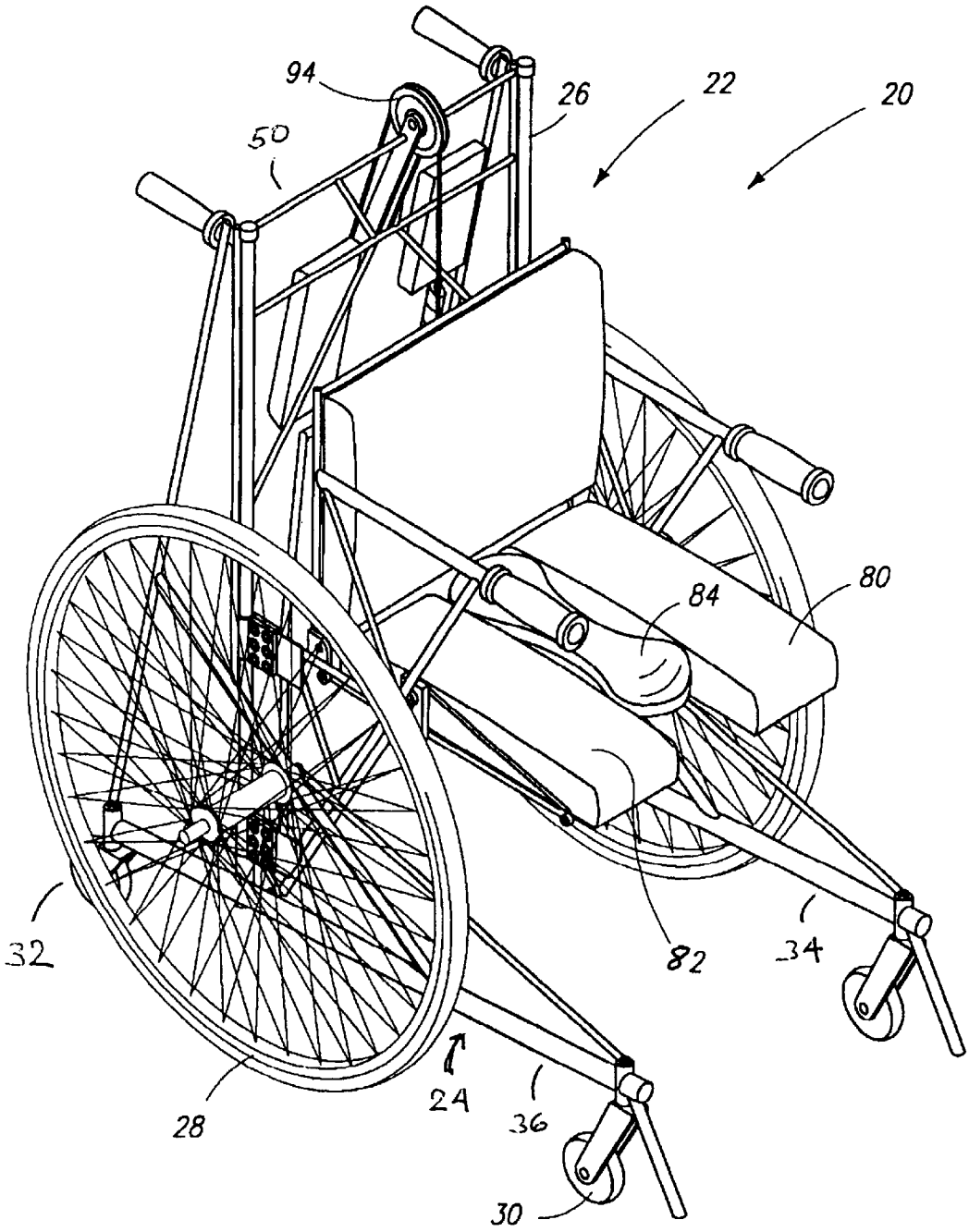
FIG. 1 is an isometric view of the present invention, with the seat carriage in the down position.

Referring now specifically to the drawings, FIG. 1 shows the disclosed walking wheel chair 20 with the seat carriage 22 in the lowered position, suitable for the user to move about in a seated position. As shown in FIG. 1, one embodiment of the disclosed invention comprises a base frame 24, the seat carriage 22, vertical tracks 26, main wheels 28, front wheels 30 and rear wheels 32. It should be noted that different geometries may be used for the base frame 24 and the other structural support members of the walking wheel chair 20 and different component groups may be added or subtracted while still retaining the functionality of the disclosed invention. The base frame 24 may be constructed of a variety of different materials, which are preferably light weight, corrosion resistant, and strong. Acceptable materials include carbon steel, alloys, aluminum, titanium, carbon fiber, and high strength plastics.

The base frame 24 provides a mounting platform for the ground-engaging front wheels 30, ground-engaging rear wheels 32, and for the various members supporting the seat carriage 22, vertical tracks 26 and main wheels 28. Both the front wheels 30 and rear wheels 32 use mounting hardware which allow each wheel to fully rotate about a vertical axis, being the type generally used for wheel-chair service which are well known among practitioners in the field. While the base frame 24 is not limited to any particular geometry, the base frame 24 is generally rectangular or "U" shaped, having either a closed or open front and a closed rear. The base frame 24 comprises a left support rail 34, a right support rail 36, and a rear rail 38. The left support rail 34 is generally parallel to the right support rail 36. At the rear of the base frame 24, the rear rail 38 connects the left support rail 34 to the right support rail 36. The optional front rail may also be attached across the open front of the base frame connecting the left support rail 34 to the right support rail 36. If installed, the front rail may be used as a foot rest when the device is used as a wheel chair. Otherwise, footrests may be attached to the left support rail 34 and to the right support rail 36.

Figure 4:
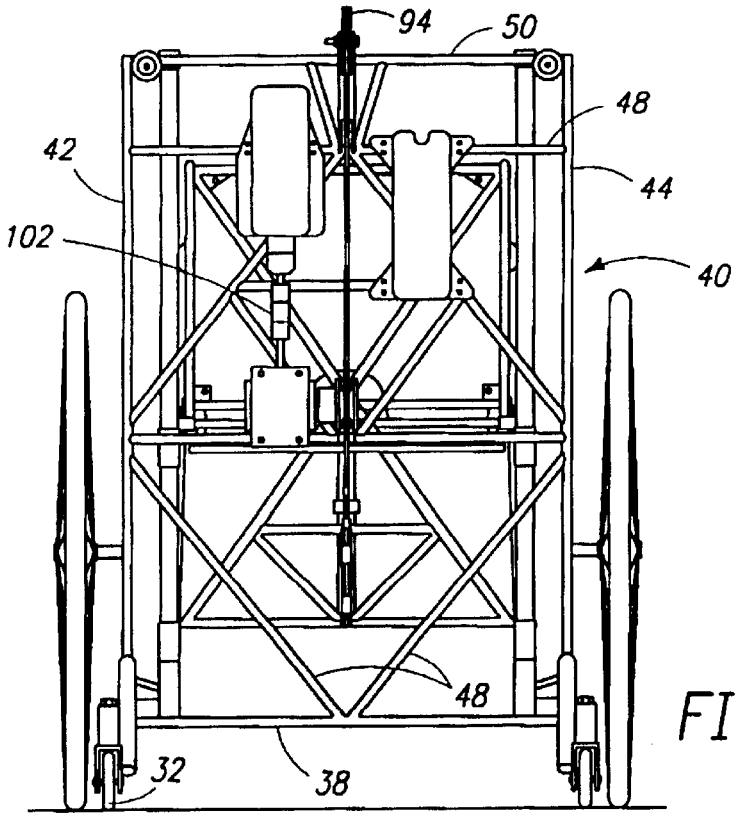
FIG. 4 shows a rear view with the seat carriage in the lower position.
Figure 5:
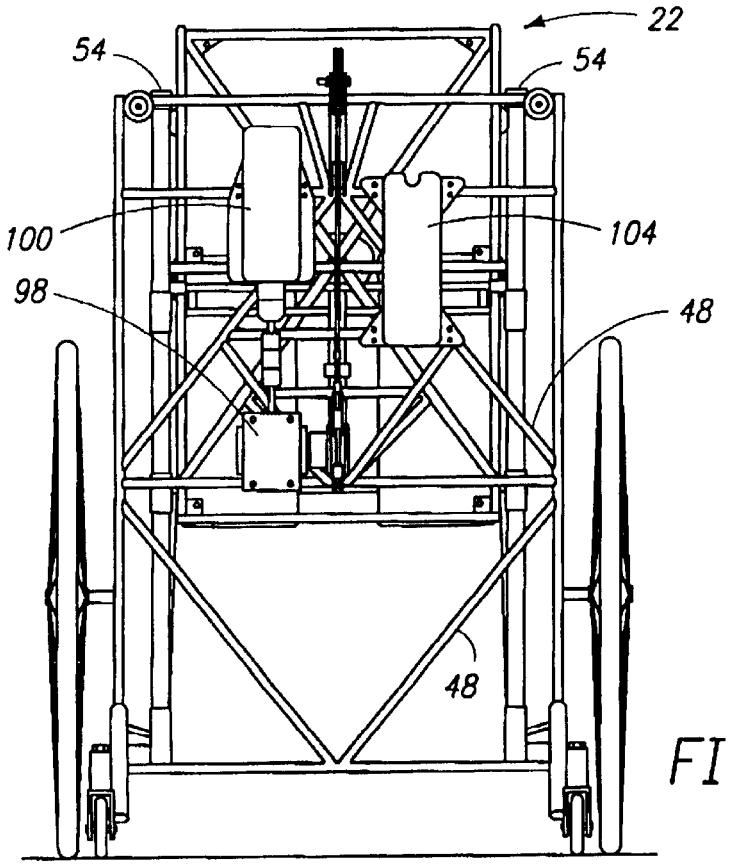
FIG. 5 shows a rear view with the seat carriage in the upper position.
Figure 6:
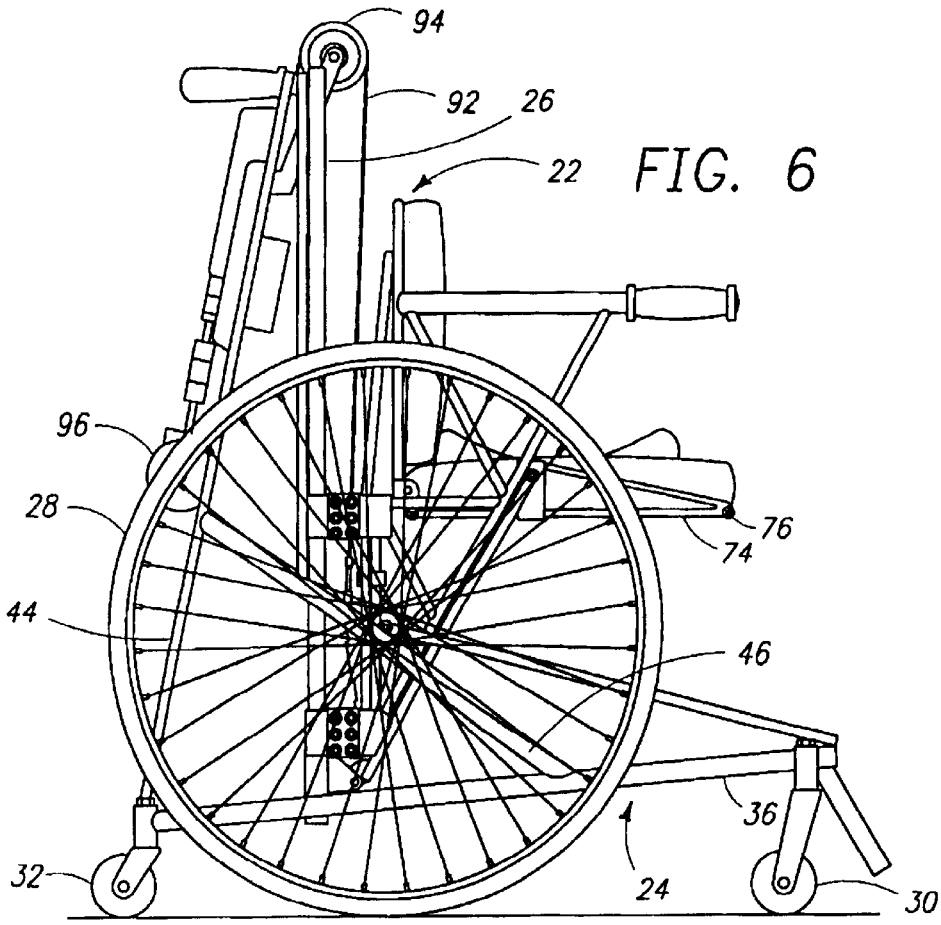
FIG. 6 shows a side view with the seat carriage in the lower position,.

A back support frame 40 may extend upwardly from the rear of the base frame 24. The back support frame 40 comprises a left upright 42 and a right upright 44, which are generally parallel to one another. As shown in FIG. 4, a plurality of brace members 48 may be installed to reinforce and strengthen the back support frame 40. A lateral support 46 may extend from the left support rail 34 to the left upright 42. Likewise, a lateral support 46 may extend from the right support rail 36 to the right upright 44. A top rail 50 may connect the left upright 42 to the right upright 44.

As detailed in FIGS. 7 through 10, the seat carriage 22 slides up and down on vertical tracks 26. The vertical tracks 26 may be attached at one end to the base frame 24 by the lower vertical track supports 52. The vertical tracks 26 may be attached at the other end to the upper vertical track supports 54. The upper vertical track supports 54 may be attached to either the top rail 50, or, in the alternative, extend from the left upright 42 and extend from the right upright 44. The lower vertical track supports 52 and the upper vertical track supports 54 are each adapted to receive and firmly retain a respective tubular end of a vertical track 26, using fastening means such as clamps, set screws, welding, soldering, or other forms of fastening. Each lower vertical track support 52 is disposed in spaced apart facing relation with a corresponding upper vertical track support 54, so that each vertical track 26 is held in place by a lower vertical track support 52 on one end and an upper vertical track support 54 at the opposite end. The vertical tracks 26 may be constructed of tubular stock, which may be polished to reduce friction between the vertical track 26 and the linear bearings 56, which slide over each vertical track 26.

Figure 2:
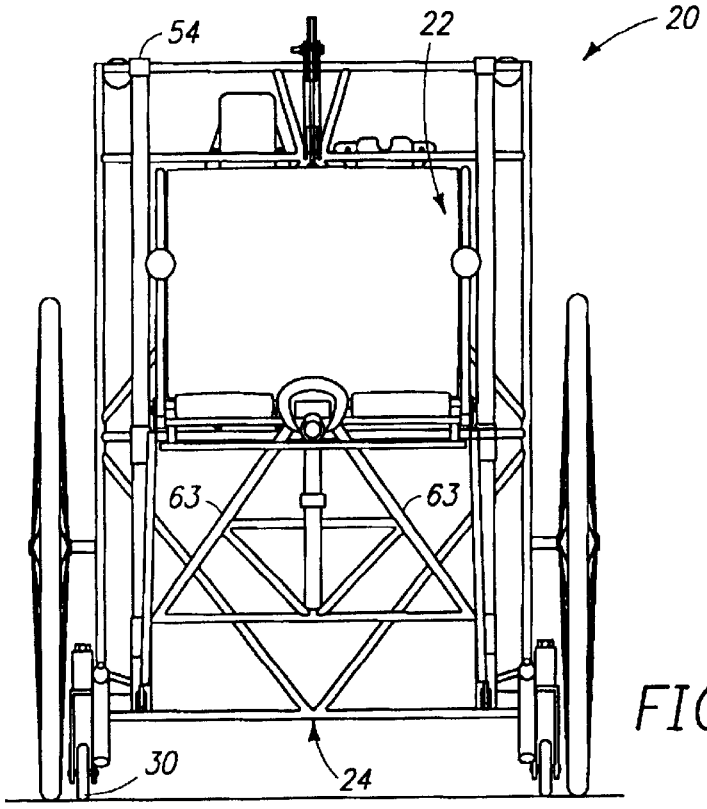
FIG. 2 is a front view of the invention with the seat carriage in the lower position.
Figure 3:
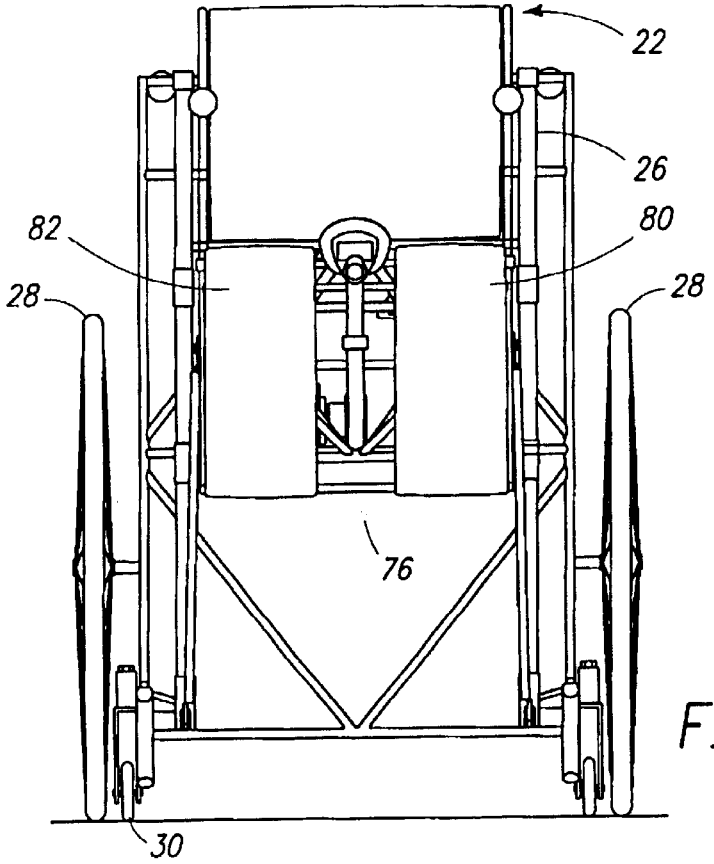
FIG. 3 shows a front view with the seat carriage in the upper position.
Figure 7:
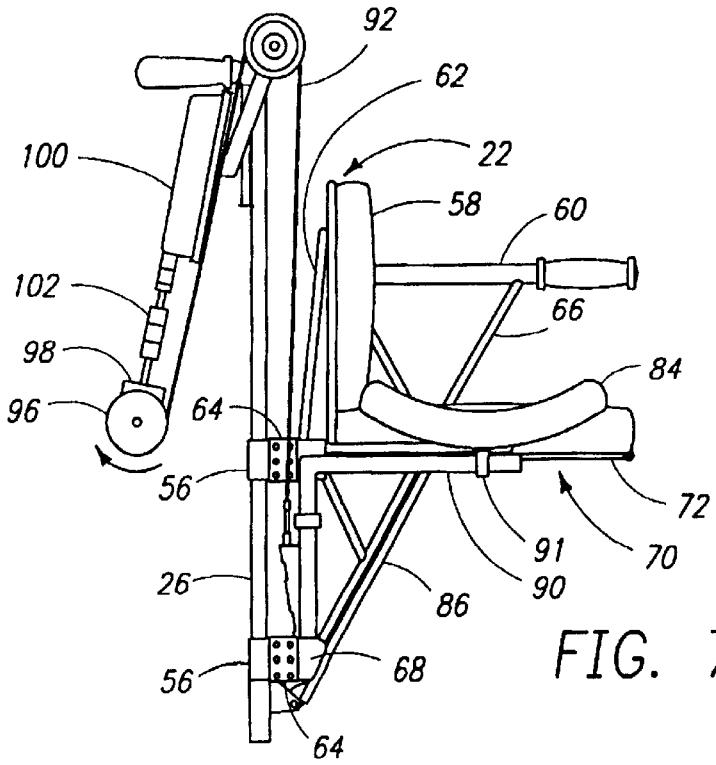
FIG. 7 shows a detailed side view of the seat carriage in the lower position.

As shown in FIG. 7, the seat carriage 22 includes an upright seat back 58, arm rests 60 which may extend around each side of the seat back 58, and the vertical frame 62. The vertical frame 62 provides the supporting framework for the seat back 58 and the components attached to the seat back 58 including the arm rests 60 and the seat frame 70. The vertical frame 62 may include a variety of stabilizing members 63, which may be installed in the triangular configuration depicted in FIG. 2, or in other configuration to provide strength and stability to the vertical frame. The stabilizing members 63 provide stability and strength to the vertical frame 62, and thus to the seat carriage 22as it is raised and lowered.

Flexible connectors 64 attach the vertical frame 62 to linear bearings 56. The linear bearings 56 slide over vertical tracks 26. As shown in FIG. 7, arm rest supports 66 extend downward from each arm rest 60 to the vertical frame joint 68.

The seat frame 70, comprising left seat frame member 72, right seat frame member 74 and a front seat frame member 76, is pivotally mounted to the seat back 58. The seat frame 70 may be pivotally attached to the seat back 58 with pin hinges 78 or other type of pivoting connector. Instead of a seat frame 70, a frameless seat may be used if the materials used for the seat are sufficiently stiff so as to support the user's body without the additional support provided by a frame, for example wood, metal, composite or suitable plastic.

A left leg support 80 is attached to the left seat frame member 72 and to the front seat frame member 76. Likewise, a right leg support 82 is attached to the right seat frame member 74 and the front seat frame member 76. The left leg support 80 and the right leg support 82 support the legs and buttocks of the user when the device is being used as a wheel chair, and may be upholstered or cushioned for the user's comfort. A saddle 84 may be attached to the vertical frame 62 so that the saddle 84 extends forwardly and generally horizontally from the vertical frame 62. The saddle 84 may be positioned between the left leg support 80 and the right leg support 82, so that when the seat frame 70 is in the horizontal position, the left leg support 80, the right leg support 82, and the saddle 84 provide a seating surface for the user. Saddle 84 is attached to saddle post 90, which is mounted to vertical frame 62. Saddle post 90 may be telescoping to as to allow height adjustments to saddle 84. In addition, the mounting bracket 91 attaching saddle 84 to saddle post 90 may provide for forward and backward adjustment, as well as changing the angle of saddle 84 to adjust the saddle to the preferences and comfort of the user.

As shown in FIGS. 7 through 10, the first end of a connecting rod 86 is pivotally attached to the left seat frame member 72. Likewise, the first end of a connecting rod 86 is pivotally attached to the right seat frame member 74. The second ends of connecting rods 86 are each pivotally attached to a sliding hinge 88, which slides on vertical tracks 26.

As the seat carriage 22 is raised, including seat back 58 connected to seat carriage 22, connecting rods 86 pivot as seat frame 70 changes from a generally horizontal first position extending forwardly from the seat back 58 to a generally vertical second position parallel to vertical tracks 26. Saddle 84, which is attached to seat carriage vertical frame 70 by saddle post 90, is raised with the seat carriage 22.

Figure 10:
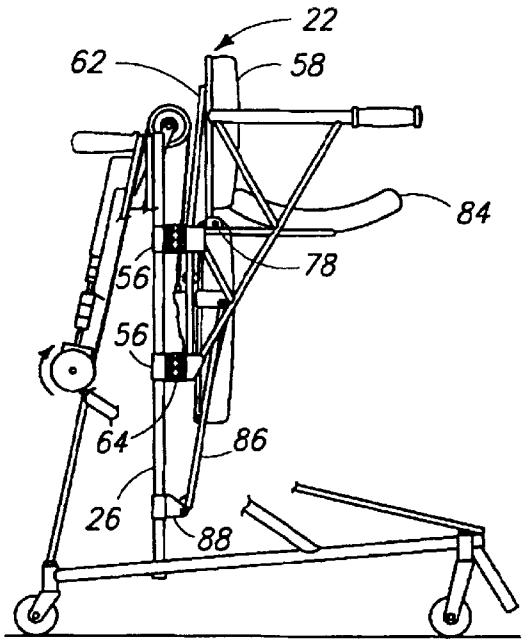
FIG. 10 shows a side view with the seat carriage in the upper position, with the main wheels removed.
Figure 9:
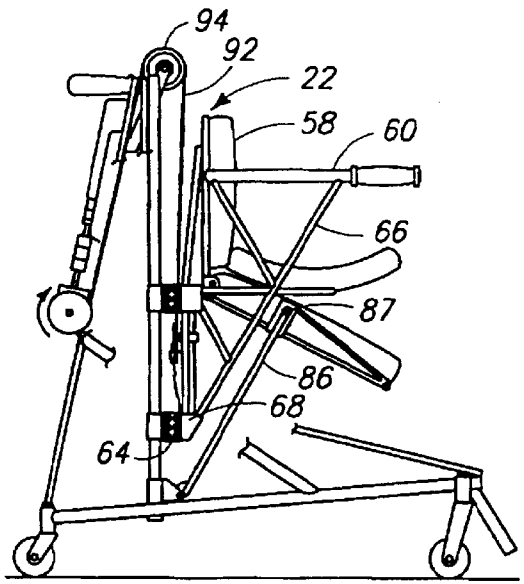
FIG. 9 shows a side view with the seat carriage being raised, with the main wheel removed.
Figure 8:
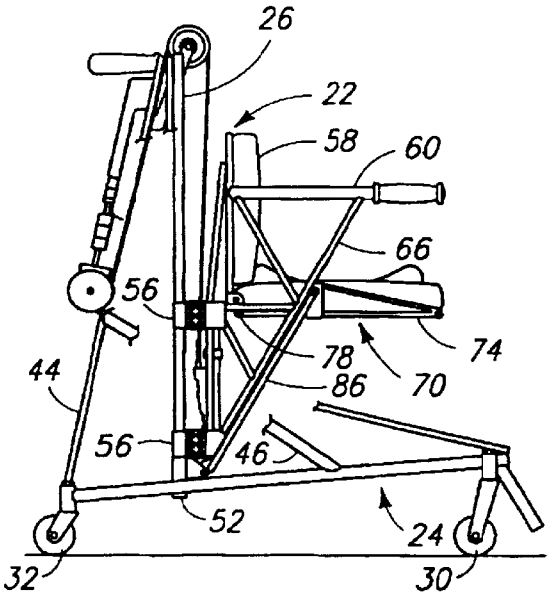
FIG. 8 shows a side view of the seat carriage in the lower position, with the main wheels removed.
Figure 11:
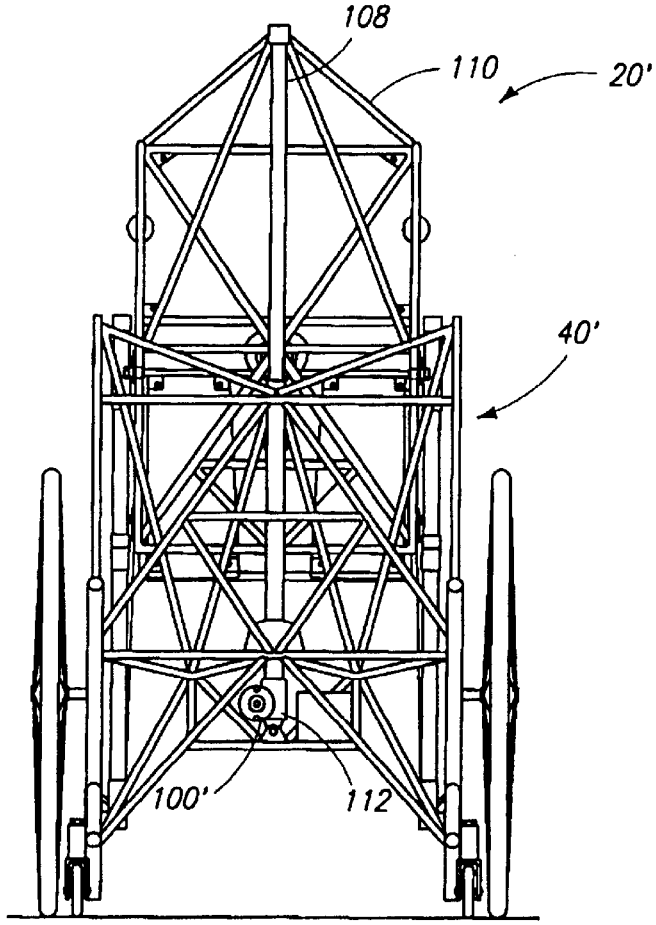
Figure 12:
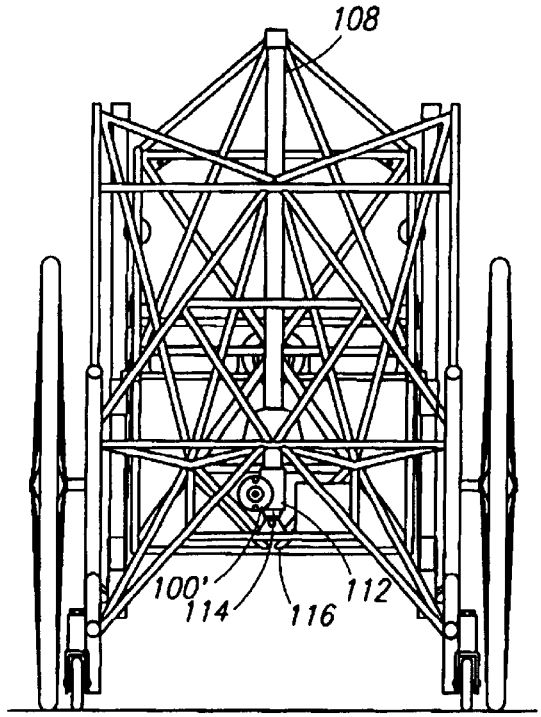
FIG. 12 shows a rear view of an alternative embodiment with the seat carriage in the lowered position.
Figure 13:
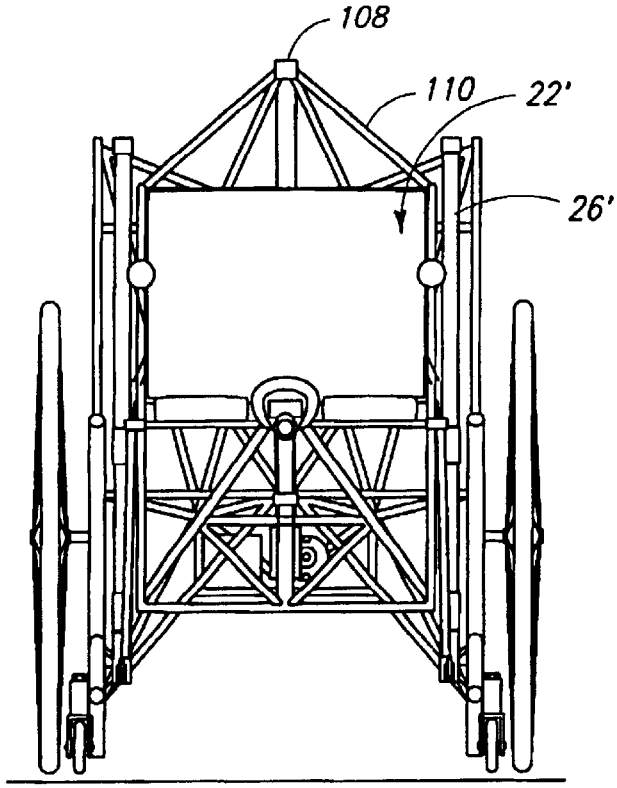
FIG. 13 shows a front view of an alternative embodiment with the seat carriage in the lower position.
Figure 14:
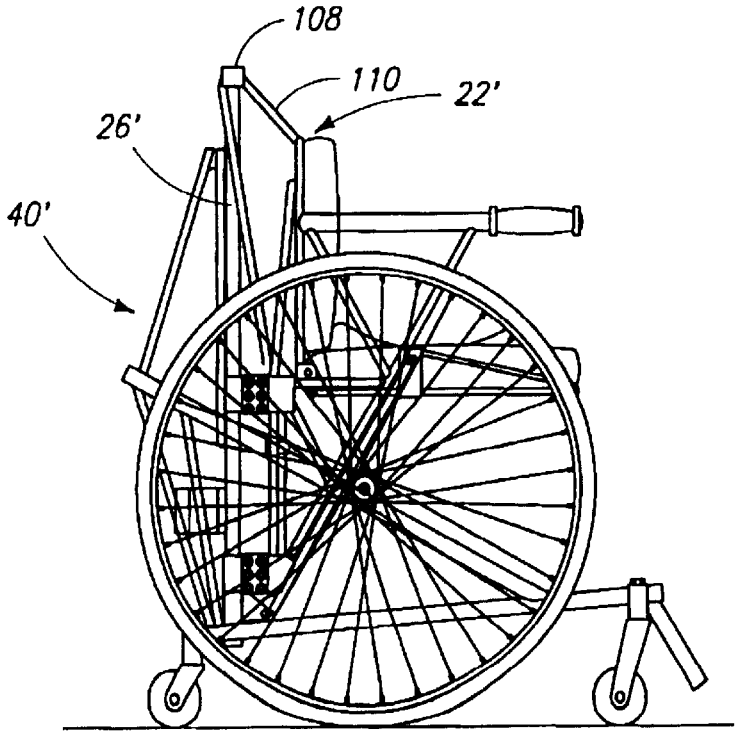
FIG. 14 shows a side view of an alternative embodiment with the seat carriage in the lower position.

As shown in FIG. 10, once connecting rods 86 approach a near vertical position, if the seat carriage 22 continues to be raised, sliding hinge 88 will start to slide up vertical track 26, thereby allowing seat carriage 22 to continue to rise with seat frame 70, in a vertical position, also sliding up vertical tracks 26. This feature of the device allows the arm rests 60 and saddle 84 to be raised to the height required to support the user when the device is to be used as a walker. As the seat carriage 22 is lowered, once sliding hinges 88 reach the bottom of the vertical track 26, the seat frame 70 begins to swing from the second vertical position to the first horizontal position. It is to be appreciated that the user may adjust the height of the seat carriage 22, and thus the height of arm rests 60 and saddle 84 and the orientation of seat frame 70, to any desire position. This feature of the invention provides the dynamic seating function of the invention which allows the user to make postural adjustments to obtain relief from the pain and discomfort caused by the inability to make small unconscious body movements.

It is to be noted that each connecting rod 86 should be attached to seat frame 70 so that connecting rod 86 never reaches a complete vertical orientation, even when the seat carriage 22 is in its highest position. It will be appreciated that if connecting rod 86 is placed in a complete vertical position, as the seat carriage 22 is lowered, once sliding hinge 88 reaches the bottom of the vertical track 26, connecting rod 86 will be placed in complete compression and will bind, preventing seat frame 70 from returning to the horizontal position. One method of preventing connecting rod 86 from reaching a complete vertical orientation is by attaching rod mount 87 to seat frame 70, and attaching connecting rod 86 to rod mount 87. Rod mount 87 offsets the point of attachment of connecting rod 86 from seat frame 70 so that when seat frame 70 is vertical, connecting rod 86 is offset from vertical, as shown in FIG. 10.

A variety of means may be used for raising and lowering the seat carriage 22. The seat carriage 22 may be set at any position on the vertical track 26 desired by the user, and retained at that position by the particular means used for raising and lowering the seat carriage 22. In the embodiment disclosed in FIGS. 1 through 10, a cable 92 is attached to the seat carriage 22. The cable 92 runs over a pulley 94, which may be attached to the top rail 50. From the pulley 94, the cable 92 runs down to a sheave 96. The sheave 96 may be attached to the shaft of a hand winch which is manually turned to wind or unwind the cable 92. The sheave 96 may also be attached to the slow-speed shaft of a gear reducer 98. An acceptable gear reducer is the Grove Gear OE Series manufactured by Regal Beloit Corporation with a ratio of 80 to 1 from the high speed to low speed shaft. A reversible electrical motor 100 may be used to turn the high speed shaft of the gear reducer 98 by connecting the motor 100 to the gear reducer 98 with linkage 102. The electrical motor 100 may be powered by rechargeable battery 104. A motor control may be used by the operator to control the motor 100, so that cable 92 is either unwound or wound up on sheave 96, and the position of the seat carriage 22 adjusted as desired by the user.

An alternative embodiment 20' is disclosed in FIGS. 11 through 14. In this embodiment, a different means for raising and lowering the seat carriage 22' is disclosed. In this embodiment, back support frame 40' is adapted to receive and support linear actuator 108. The linear actuator 108 is connected to the seat carriage 22' with lifting members 110. The motor 100' is attached to gearbox 112 of the linear actuator 108. The gearbox 112 is attached to mounting joint 114. In order to allow flexibility and prevent binding which may result from misalignment, mounting joint 114 is a flexible connection. It has been found that mounting joint 114 should be manufactured from conveyor belt rubber or a material having similar flexibility and strength characteristics. Mounting joint 114 is fastened to mounting bracket 116, which is fastened to back support frame 40'.

An acceptable linear actuator 108 is an 18" stroke linear actuator manufactured by Motion Systems, which has a gear box ratio of 20 to 1. An acceptable motor 100' is also manufactured by Motion Systems, the motor being 12 volts and turning at 3000 RPM. As with the embodiment 20 discussed above, in which the seat carriage 22' may be raised or lowered with a cable 92 to any desired position along the vertical track 26', the embodiment 20' using the linear actuator allows the user to stop the seat carriage 22' at any desired position along the vertical track 26', from a completely seated position to a full standing position.

While the above is a description of various embodiments of the present invention, further modifications may be employed without departing from the spirit and scope of the present invention. For example, the size, shape, and/or material of the various components may be changed as desired. In particular, any number of frame geometries, support structures, and wheel configurations may be adapted for use with the present invention. Thus the scope of the invention should not be limited by the specific structures disclosed. Instead the true scope of the invention should be determined by the following claims.

What is claimed is:

1. A wheel chair comprising:

(a) a base frame having a front and a rear;

(b) a back support frame, extending upwardly from the rear of the base frame;

(c) a plurality of lower vertical track supports attached to the base frame;

(d) a plurality of upper vertical track supports attached to the back support frame, each lower vertical track support disposed in spaced apart facing relation with a matching upper vertical track support;

(e) a plurality of ground-engaging wheels attached to the base frame;

(f) a plurality of vertical tracks, each vertical track disposed between a lower vertical track support and a matching upper vertical track support;

(g) a seat carriage, comprising a vertical frame, an upright seat back, and a seat frame, the seat carriage slideably attached to the plurality of vertical tracks such that the seat carriage may be slid and positioned from a lower position up to and including an upper position and from the upper position to the lower position;

(h) the upright seat back attached to the vertical frame;

(i) arm rests attached to the seat carriage;

(j) the seat frame, comprising a left member, a right member and a front member, the seat frame pivotally mounted to the vertical frame such that as the seat carriage is raised, the seat frame swings over a range from a generally horizontal first position extending perpendicularly from the vertical frame to a generally vertical second position parallel to the vertical tracks, and as the seat carriage is lowered, the seat frame swings from the second position to the first position;

(k) a left leg support attached to the left member and the front member of the seat frame and a right leg support attached to the right member and the front member of the seat frame;

(l) a saddle extending forwardly and generally horizontally from the vertical frame, the saddle positioned between the left leg support and the right leg support, so that when the seat frame is in the first position, the left leg support, the right leg support, and the saddle provide a seating surface for the person; and (m) means for raising said seat carriage to the upper position and for lowering said seat carriage to the, lower position.

2. The wheel chair of claim 1 wherein the seat carriage is slideably attached to the vertical tracks with vertical bearings.

3. The wheel chair of claim 2 wherein the vertical bearings are attached to the seat carriage with flexible connectors.

4. The wheel chair of claim 1 wherein the means for raising and lowering the seat carriage comprises a cable having a first and second end, the first end attached to the seat carriage and the second end attached to a sheave, the sheave attached to a gearbox and the gearbox coupled to a motor.

5. The wheel chair of claim 1 wherein the means for raising and lowering the seat carriage comprises a motor coupled to a linear actuator, wherein the linear actuator is attached to the vertical frame.

6. The wheel chair of claim 1 wherein the ground-engaging wheels further comprise a left ground-engaging main wheel, a right ground-engaging main wheel, front wheels and rear wheels.

7. A wheel chair comprising:

(a) a base frame, having a front and a rear, comprising a left support rail, a right support rail, and a rear rail, the left support rail generally parallel to the right support rail, and the rear rail connecting the left support rail to the right support rail;

(b) a back support frame, having a left side and a right side, extending upwardly from the rear of the base frame;

(c) a lateral support extending from the left support rail to the left side of the back support frame;

(d) a lateral support extending from the right support rail to the right side of the back support frame;

(e) a top rail connecting the left side of the back support frame to the right side of the back support frame;

(f) a lower vertical track support attached to the left support rail and an upper vertical track support attached to the top rail, the lower vertical track support and the upper vertical track support disposed in spaced apart facing relation;

(g) a lower vertical track support attached to the right support rail and an upper vertical track support attached to the top rail, the lower vertical track support and the upper vertical track support disposed in spaced apart facing relation;

(h) front wheels attached to the base frame;

(i) rear wheels attached to the base frame;

(j) main wheels attached to the lateral supports;

(k) a vertical track disposed between the lower vertical track support attached to the left support rail and the facing upper vertical track support attached to the top rail;

(l) a vertical track disposed between the lower vertical track support attached to the right support rail and the facing upper vertical track support attached to the top rail;

(m) a seat carriage, comprising a vertical frame, an upright seat back, and a seat frame, the seat carriage slideably attached to the left vertical track and the right vertical track such that the seat carriage may be slid from and positioned from a lower position up to and including an upper position and from the upper position to the lower position;

(n) the upright seat back attached to the vertical frame;

(o) arm rests attached to the seat carriage;

(p) the seat frame comprising a left member, a right member and a front member, the seat frame pivotally mounted to the vertical frame such that as the seat carriage is raised, the seat frame swings over a range from a generally horizontal first position extending perpendicularly from the vertical frame to a generally vertical second position parallel to the vertical tracks, and as the seat carriage is lowered, the seat swings from the second position to the first position;

(q) a left leg support attached to the left member and the front member of the seat frame and a right leg support attached to the right member and the front member of the seat frame;

(r) a saddle extending forwardly and generally horizontally from the vertical frame, the saddle positioned between the left leg support and the right leg support, so that when the seat frame is in the first position, the left leg support, the right leg support, and the saddle provide a seating surface for the person; and (s) means for raising said seat carriage to the upper position and for lowering said seat carriage to the lower position.

8. The wheel chair of claim 7 wherein the seat carriage is slideably attached to the left vertical track and the right vertical track with vertical bearings.

9. The wheel chair of claim 8 wherein the vertical bearings are attached to the seat carriage with flexible connectors.

10. The wheel chair of claim 7 wherein the means for raising and lowering the seat carriage comprises a cable having a first and second end, the first end attached to the seat carriage and the second end attached to a sheave, the sheave attached to a gearbox and the gearbox coupled to a motor.

11. The wheel chair of claim 7 wherein the means for raising and lowering the seat carriage comprises a motor coupled to a linear actuator, wherein the linear actuator is attached to the vertical frame.

12. A wheel chair comprising:

(a) a base frame, having a front and a rear, comprising a left support rail, a right support rail, and a rear rail, the left support rail generally parallel to the right support rail, and the rear rail connecting the left support rail to the right support rail;

(b) a back support frame, having a left side and a right side, extending upwardly from the rear of the base frame;

(c) a lateral support extending from the left support rail to the left side of the back support frame;

(d) a lateral support extending from the right support rail to the right side of the back support frame;

(e) a top rail connecting the left side of the back support frame to the right side of the back support frame;

(f) a lower vertical track support attached to the left support rail and an upper vertical track support attached to the top rail, the lower vertical track support and the upper vertical track support disposed in spaced apart facing relation;

(g) a lower vertical track support attached to the right support rail and an upper vertical track support attached to the top rail, the lower vertical track support and the upper vertical track support disposed in spaced apart facing relation;

(h) front wheels attached to the base frame;

(i) rear wheels attached to the base frame;

(j) main wheels attached to the lateral supports;

(k) a vertical track disposed between the lower vertical track support attached to the left support rail and the facing upper vertical track support attached to the top rail;

(l) a vertical track disposed between the lower vertical track support attached to the right support rail and the facing upper vertical track support attached to the top rail;

(m) a seat carriage, comprising a vertical frame, an upright seat back, and a seat frame, the seat carriage slideably attached to the left vertical track and the right vertical track such that the seat carriage may be slid from and positioned from a lower position up to and including an upper position and from the upper position to the lower position;

(n) the upright seat back attached to the vertical frame;

(o) arm rests attached to the seat carriage;

(p) the seat frame comprising a left member, a right member and a front member, the seat frame pivotally mounted to the vertical frame such that as the seat carriage is raised, the seat frame swings over a range from a generally horizontal first position extending perpendicularly from the vertical frame to a generally vertical second position parallel to the vertical tracks, and as the seat carriage is lowered, the seat swings from the second position to the first position;

(q) a left leg support attached to the left member and the front member of the seat frame and a right leg support attached to the right member and the front member of the seat frame;

(r) a saddle attached to the vertical frame, the saddle positioned between the left leg support and the right leg support, so that when the seat frame is in the first position and the saddle is in the generally horizontal position, the left leg support, the right leg support, and the saddle provide a seating surface;

(s) a pulley attached to the top rail of the frame;

(t) a motor attached to the back support frame;

(u) a gearbox having a high speed shaft and a low speed shaft, the high speed shaft coupled to the motor arid the low speed shaft attached to a sheave; and (v) a cable having a first and second end, the first end attached to the seat carriage, the cable looping over the pulley, and the second end attached to the sheave.

13. The wheel chair of claim 12, further comprising a rechargeable battery pack for supplying power to the motor.

14. A wheel chair comprising:

(a) a base frame, having a front and a rear, comprising a left support rail, a right support rail, and a rear rail, the left support rail generally parallel to the right support rail, and the rear rail connecting the left support rail to the right support rail;

(b) a back support frame, having a left side and a right side, extending upwardly from the rear of the base frame;

(c) a lateral support extending from the left support rail to the left side of the back support frame;

(d) a lateral support extending from the right support rail to the right side of the back support frame;

(e) a top rail connecting the left side of the back support frame to the right side of the back support frame;

(f) a lower vertical track support attached to the left support rail and an upper vertical track support attached to the top rail, the lower vertical track support and the upper vertical track support disposed in spaced apart facing relation;

(g) a lower vertical track support attached to the right support rail and an upper vertical track support attached to the top rail, the lower vertical track support and the upper vertical track support disposed in spaced apart facing relation;

(h) front wheels attached to the base frame;

(i) rear wheels attached to the base frame;

(j) main wheels attached to the lateral supports;

(k) a vertical track disposed between the lower vertical track support attached to the left support rail and the facing upper vertical track support attached to the top rail;

(l) a vertical track disposed between the lower vertical track support attached to the right support rail and the facing upper vertical track support attached to the top (m) a seat carriage, comprising a vertical frame, an upright seat back, and a seat frame, the seat carriage'slideably attached to the left vertical track and the right vertical track such that the seat carriage may be slid and positioned from a lower position up to and including an upper position and from the upper position to the lower position;

(n) the upright seat back attached to the vertical frame;

(o) arm rests attached to the seat carriage;

(p) the seat frame comprising a left member, a right member and a front member, the seat frame pivotally mounted to the vertical frame such that as the seat carriage is raised, the seat frame swings over a range from a generally horizontal first position extending perpendicularly from the vertical frame to a generally vertical second position parallel to the vertical tracks, and as the seat carriage is lowered, the seat swings from the second position to the first position;

(q) a left leg support attached to the left member and the front member of the seat frame and a right leg support attached to the right member and the front member of the seat frame;

(r) a saddle attached to the vertical frame, the saddle positioned between the left leg support and the right leg support, so that when the seat frame is in the first position and the saddle is in the generally horizontal position, the left leg support, the right leg support, and the saddle provide a seating surface;

(s) a motor attached to the back support frame; and (t) a linear actuator coupled to the motor wherein the linear actuator is attached to the vertical frame.

15. The wheel chair of claim 14, further comprising a rechargeable battery pack for supplying power to the motor.

* * * * *